US010906561B2

(12) United States Patent
Jones et al.

(10) Patent No.: US 10,906,561 B2
(45) Date of Patent: Feb. 2, 2021

(54) DISCHARGE GATE ARRANGEMENTS FOR RAILROAD HOPPER CARS

(71) Applicant: Gunderson LLC, Portland, OR (US)

(72) Inventors: Peter L. Jones, Southlake, TX (US); Caglar Ozerdim, Dallas, TX (US)

(73) Assignee: Gunderson LLC, Portland, OR (US)

( * ) Notice: Subject to any disclaimer, the term of this patent is extended or adjusted under 35 U.S.C. 154(b) by 272 days.

(21) Appl. No.: 16/110,015

(22) Filed: Aug. 23, 2018

(65) Prior Publication Data

US 2020/0062280 A1 Feb. 27, 2020

(51) Int. Cl.
*B61D 7/02* (2006.01)
*B61D 7/26* (2006.01)

(52) U.S. Cl.
CPC *B61D 7/02* (2013.01); *B61D 7/26* (2013.01)

(58) Field of Classification Search
CPC ... B61D 7/00; B61D 7/02; B61D 7/04; B61D 7/06; B61D 7/16; B61D 7/20; B61D 7/24
See application file for complete search history.

(56) References Cited

U.S. PATENT DOCUMENTS

| | | | | |
|---|---|---|---|---|
| 3,348,501 | A | 10/1967 | Stevens et al. | |
| 4,601,244 | A | 7/1986 | Fischer | |
| 5,829,359 | A | 11/1998 | Dohr et al. | |
| 6,286,437 | B1 | 9/2001 | Lucas | |
| 6,363,863 | B1 | 4/2002 | Dohr | |
| 6,502,518 | B1 | 1/2003 | Miller | |
| 7,051,661 | B2 * | 5/2006 | Herzog | B61D 7/02 105/286 |
| 7,367,271 | B2 | 5/2008 | Early | |
| 7,735,426 | B2 * | 6/2010 | Creighton | B61D 7/28 105/286 |
| 8,915,194 | B2 * | 12/2014 | Creighton | B61D 7/24 105/286 |
| 2015/0000555 | A1 * | 1/2015 | Klinkenberg | B61D 7/20 105/282.2 |

FOREIGN PATENT DOCUMENTS

CN 104875756 A 9/2015

OTHER PUBLICATIONS

Australian Railroad Group, Vehicle Data Sheet—XT Class, 1 page, (prior to Mar. 26, 2018).

(Continued)

*Primary Examiner* — Robert J McCarry, Jr.
(74) *Attorney, Agent, or Firm* — Chernoff Vilhauer LLP

(57) ABSTRACT

A railroad hopper car having a single cargo-receiving hopper extending over substantially the length of a car body having a cargo discharge portion occupying most of the available distance between the wheeled trucks supporting opposite ends of the car body. The car has no pair of slope sheets separating longitudinally-adjacent hoppers and defining unusable space beneath the slope sheets, and so the overall length of such a hopper car capable of carrying a desired volume of cargo can be less than that of one with multiple separate hoppers. Cargo discharge openings are arrayed along the length of the cargo discharge portion, and a unitary multi-gate assembly is supported within the cargo discharge portion of the car body so as to be movable longitudinally of the car body to open or close all of the cargo discharge openings simultaneously.

18 Claims, 13 Drawing Sheets

(56) References Cited

OTHER PUBLICATIONS

Australian Railroad Group, Vehicle Data Sheet—XU Class, 1 page, (prior to Mar. 26, 2018).
Photograph of CBHS Group Australian railroad hopper car 01077c, dated Feb. 10, 2012, 1 page.
United Group Rail, "Aluminum Grain Freight Vehicle XT" (Westrail 1999-2001), photograph from Mar. 2009 product brochure, 1 page.
United Group Rail, "Coal Hopper Freight Vehicle NHFF (100 Tonne)" (State Rail Authority of NSW, 1982-1984) photograph from Mar. 2009 product brochure, 1 page.
United Group Rail, "Coal Hopper Freight Vehicle NHKF (100 Tonne)" (State Rail Authority of NSW, 1987-1988), photograph from Mar. 2009 product brochure, 1 page.
Australian Railroad Group Pty Ltd, "Wagon Class XU Grain Hopper Wagon", Drawing No. 60295, 1 page, Sep. 19, 2003.
Australian Railroad Group Pty Ltd, "Wagon Class XT Grain Hopper Wagon", Drawing No. 60289, 1 page. Sep. 23, 2003.
Westrail, "'XT' Class Grain Wagon", CME DRG No. CME 31813, 1 page, (prior to Mar. 26, 2018).

* cited by examiner

DISCHARGE GATE ARRANGEMENTS FOR RAILROAD HOPPER CARS

BACKGROUND OF THE INVENTION

The present invention relates to railroad hopper cars, and particularly to a gravity outlet cargo discharge gate arrangement in a hopper car that may be shorter in overall length than previously known hopper cars with the same volumetric cargo capacity.

Most conventional railroad hopper cars have two or three or more separate cargo-containing hoppers, with each hopper having a separate, rectangular, cargo discharge chute and an associated cargo discharge gate. Various funnel-like arrangements of slope sheets have conventionally defined a chute to guide bulk cargo to a respective discharge gate. A pair of slope sheets conventionally define a transversely-extending ridge structure in such a railroad hopper car to define separate longitudinally adjacent hoppers and to guide cargo within each hopper toward a respective discharge gate. A significant amount of space is defined beneath such a transversely-extending ridge.

The gravity outlet cargo discharge gates in conventional railroad hopper cars may be about three feet square to direct bulk cargo such as grain flowing from a hopper into a receptacle that may be no wider than the space between the rails on which the hopper car is supported. Emptying the cargo from a hopper car with such a discharge gate may require the car to be moved to place each cargo discharge gate, in turn, above a receptacle for a long enough time for all the cargo in the particular hopper to flow into the receptacle. It is desirable, however, to be able to unload the cargo from a hopper car quickly, so as to enable all of the cars of a train to be unloaded without a great deal of delay.

A gravity outlet cargo discharge assembly may typically include a sliding discharge gate, a horizontal closure member that supports the weight of cargo when the gate is closed, and so a certain amount of force is required to open such a gravity outlet cargo discharge gate. US railroad operating rules limit the amount of force that should be required to open a cargo discharge gate. In some railroad hopper cars including a larger gravity outlet cargo discharge structure a shed plate is located above the gate and partially supports the weight of cargo, but space is provided for cargo to flow onto the gate and through the cargo discharge opening when the gate is opened. As a result of that structure, the weight of cargo actually supported by the closed gate is somewhat reduced, thereby reducing the force needed to open the gate.

Some railroad hopper cars have been constructed recently to define only two hoppers, one being located at each of the opposite ends of such a hopper car. The hoppers of such cars are separated, however, by a pair of slope sheets forming a large, transversely oriented ridge between the hoppers. In some such hopper cars large gravity outlet cargo discharge gate assemblies have been provided, allowing cargo to be discharged from each of the hoppers into receptacles that are wider than the space between the rails. Such a pair of cargo discharge gate assemblies may extend longitudinally through a significant part of the length of such a car, between its wheeled trucks, but a significant amount of space is defined beneath the pair of slope sheets separating the hoppers and unusable to contain cargo. Cargo space equal to the unusable space beneath such a pair of slope sheets can be provided in a car designed to satisfy a particular set of clearance plate requirements only by providing a sufficiently long car body.

In some places the length of a railroad train is limited by regulations, or by the available length of sidings or parallel track sections where one train can wait temporarily while another train passes by. In some cases, carrying a greater amount of cargo on a train of such a limited length would lead to more efficient use of locomotive power. It may therefore be advantageous to be able to load a certain amount of cargo onto a shorter car and include a larger number of such shorter cars in a train not exceeding a prescribed length, to carry a greater amount of cargo weight in a train of a particular length and thereby make practical use of more of the power that is available from the number of locomotives required.

What is needed, then, is a railroad hopper car that is shorter in length than previously available hopper cars capable of carrying the same volume and weight of cargo; it is also desirable for such a car to be able to quickly discharge its cargo.

SUMMARY OF THE INVENTION

The present invention, defined by the claims that form a part of the present disclosure, provides an answer to some of the needs explained above by providing a railroad hopper car that is significantly shorter than a conventional railroad hopper car that has the same volumetric cargo capacity, and that has an ability to discharge bulk cargo more quickly than previous hopper cars.

In one embodiment of the hopper car disclosed herein there is but a single cargo-carrying hopper that extends over the length of the car body, so that the hopper car has no large transversely-extending ridge formed by slope sheets separating individual hoppers from one another.

An aspect of one embodiment of the hopper car disclosed herein is a cargo hopper outlet portion including a discharge gate assembly extending over a majority of the length of the car body between the wheeled trucks supporting each end of the car body.

In one embodiment of the hopper car disclosed herein the cargo hopper outlet portion includes a cargo discharge gate assembly, including a plurality of cargo discharge openings spaced apart from one another along the length of the car body, and an associated unitary multi-gate closure assembly includes a like plurality of gate closure members connected with each other and movable as a unit, to open or close all of the cargo discharge openings simultaneously.

In one embodiment of the hopper car disclosed herein a unitary multi-gate closure assembly includes a pair of opposite longitudinal side rails each extending over the entire length of the unitary gate assembly on a respective lateral side, and ail the individual gate closure members are connected to both of the longitudinal rails.

In one embodiment of the hopper car disclosed herein each of the individual cargo discharge openings has a width dimension that is greater than its length dimension. The individual cargo discharge openings are separated from one another along the length of the car body by a distance that may be about equal to or slightly greater than the length of each cargo discharge opening.

In one embodiment of the hopper car disclosed herein the cargo hopper outlet portion includes a pair of rows of cargo discharge openings extending alongside each other on opposite lateral sides of a longitudinal centerline of the car body, and a separate cargo discharge gate assembly is associated with each of the rows of cargo discharge openings.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
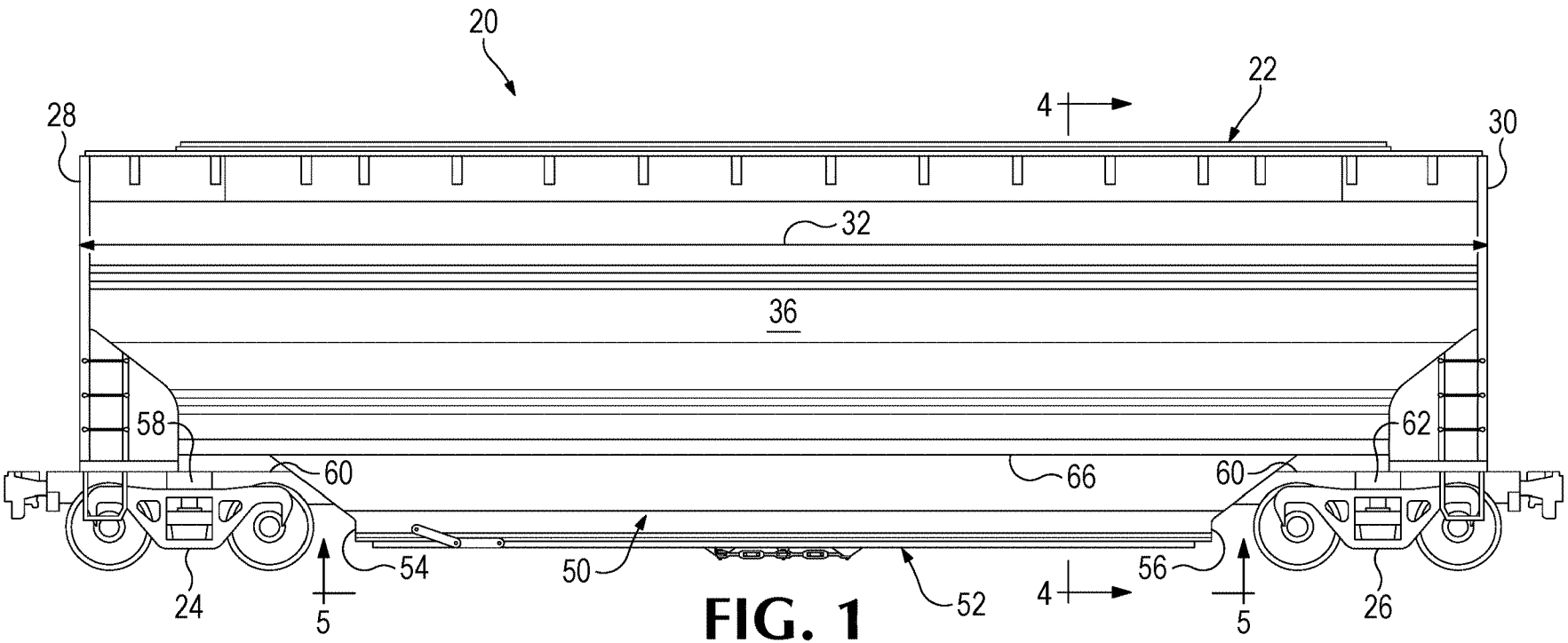
FIG. 1 is a side elevational view of a railroad hopper car embodying certain aspects of the present invention.

Referring now to the drawings which form a part of the disclosure herein, as shown in FIGS. 1-16 a railroad hopper car 20 has a car body 22 supported on a pair of wheeled trucks 24 and 26, each supporting a respective end 28 or 30 of the car body 22. The car body 22 has a length 32 between its opposite ends 28 and 30 and has a pair of opposite side walls 34 and 36 extending along the length 32 and defining an overall width 37 of the car body 22. There are slope sheets 38 and 40 at the opposite ends 28 and 30, respectively, interconnecting with the side walls 34 and 36, and the side walls and slope sheets define a single cargo hopper 42 for holding bulk cargo such as grain or other granular or powdered material that can flow freely out of the hopper 42. A gravity outlet cargo discharge gate assembly includes gates that may be opened or closed to retain cargo or allow it to be discharged from the cargo hopper 42.

Figure 2:
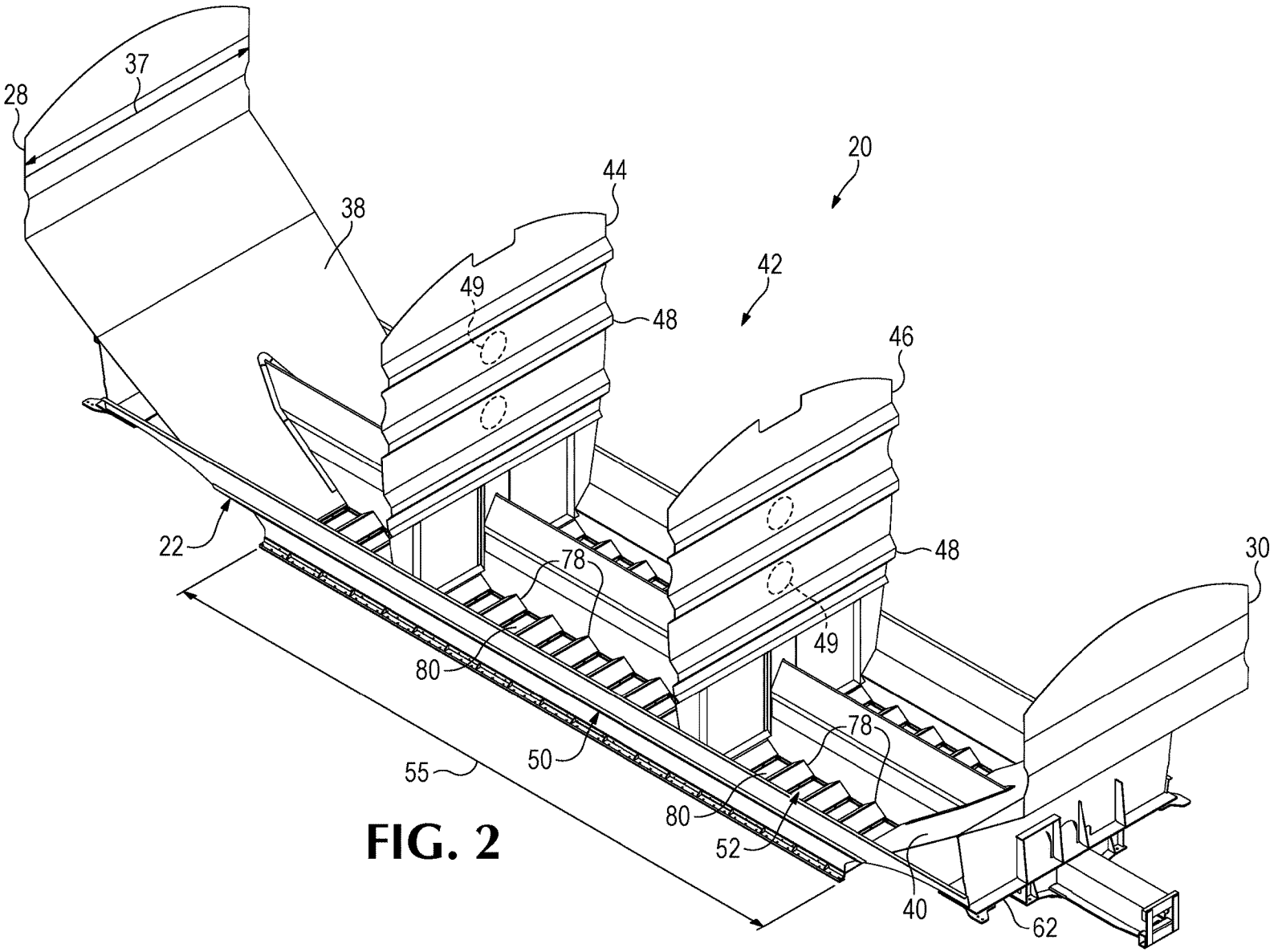
FIG. 2 is an isometric view from near an end of the car body of the hopper car shown in FIG. 1, from which the top and side walls have been omitted to allow the bottom portion of the hopper including the gravity outlet cargo discharge gate assembly to be seen.
Figure 3:
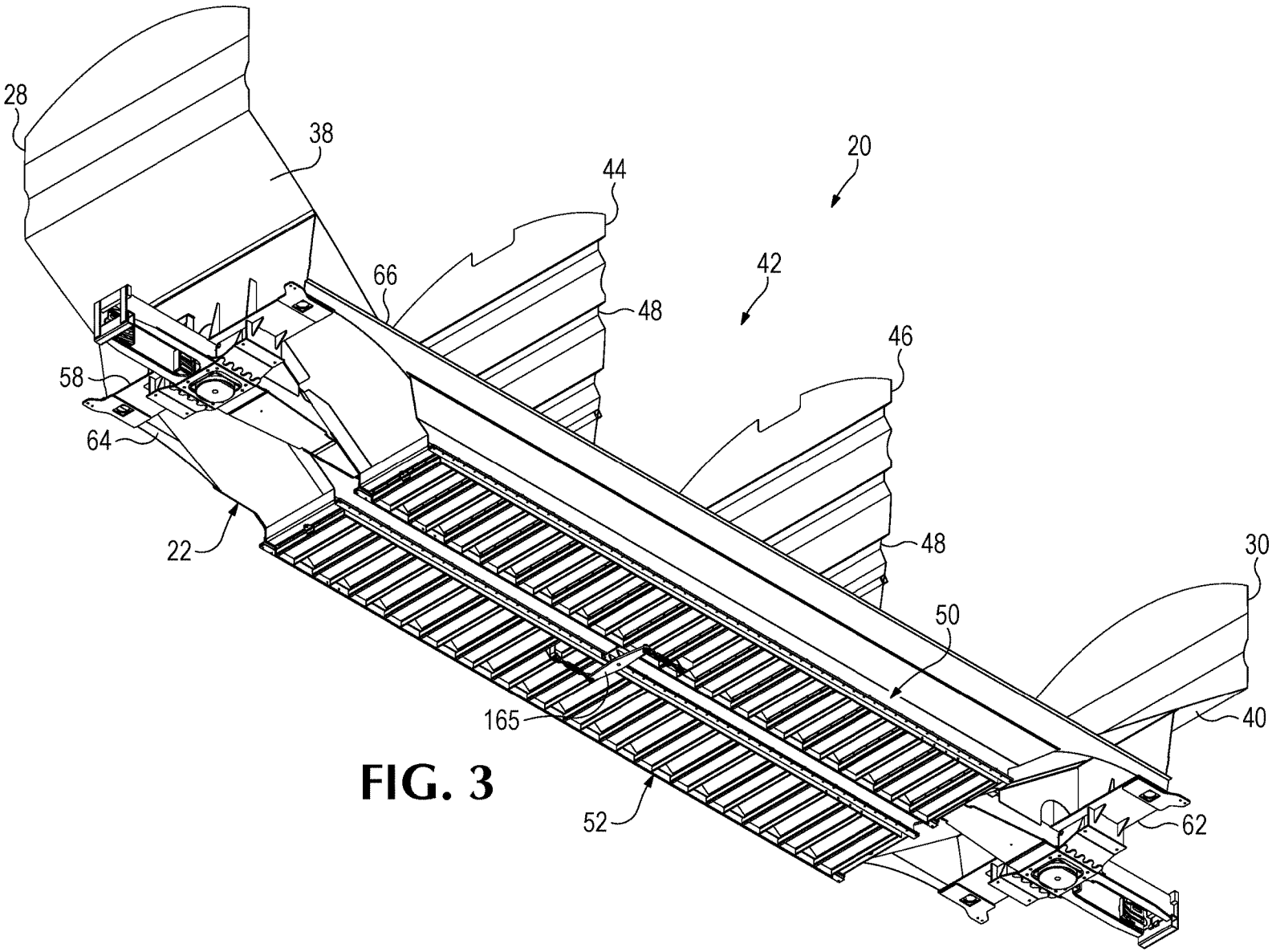
FIG. 3 is an isometric view from below the car body of the hopper car shown in FIGS. 1 and 2, from which the top and side walls have been omitted to allow transverse bulkheads within the cargo hopper to be seen.

The car body 22 may incorporate one or more transverse bulkheads 44 and 46, shown in FIGS. 2 and 3, interconnecting and providing lateral support for the side walls 36 and 38 of the cargo hopper. The transverse bulkheads 44 and 46 may be shaped to include transversely extending stiffeners 48 to withstand forces of cargo pressing in a longitudinal direction with respect to the car body 22. Alternatively, the transverse bulkheads 44 and 46 may define one or more holes 49 through which granular cargo can flow freely, so that the bulkheads 44 and 46 are not required to support significant longitudinal forces from the weight of cargo. As shown herein, there are two such transverse bulkheads 44 and 46 which may be located, for example, so as to divide the volume of the cargo hopper 42 approximately into thirds.

A respective one of the slope sheets 38 and 40 defines each end of the hopper 42, and the car body 22 has space beneath each slope sheet where equipment related to the operability of the hopper car 20 may be mounted above the respective wheeled truck 24 or 26. The slope sheets 38 and 40 serve to guide cargo as it slides downward to a hopper outlet portion 50 of the hopper 42, and they also allow cargo to be carried in the hopper 42 in much of the space above the locations of the wheeled trucks 24 and 26.

As shown in FIG. 2, the hopper outlet portion 50 of the car body 22 includes a cargo discharge gate assembly 52 that extends generally horizontally and longitudinally along the car body 22 between the wheeled trucks 24 and 26. The gravity outlet cargo discharge gate assembly 52 extends generally horizontally at the bottom of the hopper outlet portion 50 with a width 53, and a length 55 through the entire distance from an end 54 of the hopper outlet portion near the wheeled truck 24 to an opposite end 56 of the hopper outlet portion 50, near the other wheeled truck 26 at the other end 30 of the hopper car 20. Unlike previously known hopper cars, there is no pair of slope sheets defining a large transversely oriented ridge in a middle portion of the length 32 of the car body 22 as would be needed in a hopper car having a pair of separate hoppers or a pair of longitudinally separate cargo discharge gate assemblies as in previously known hopper cars.

Figure 4:
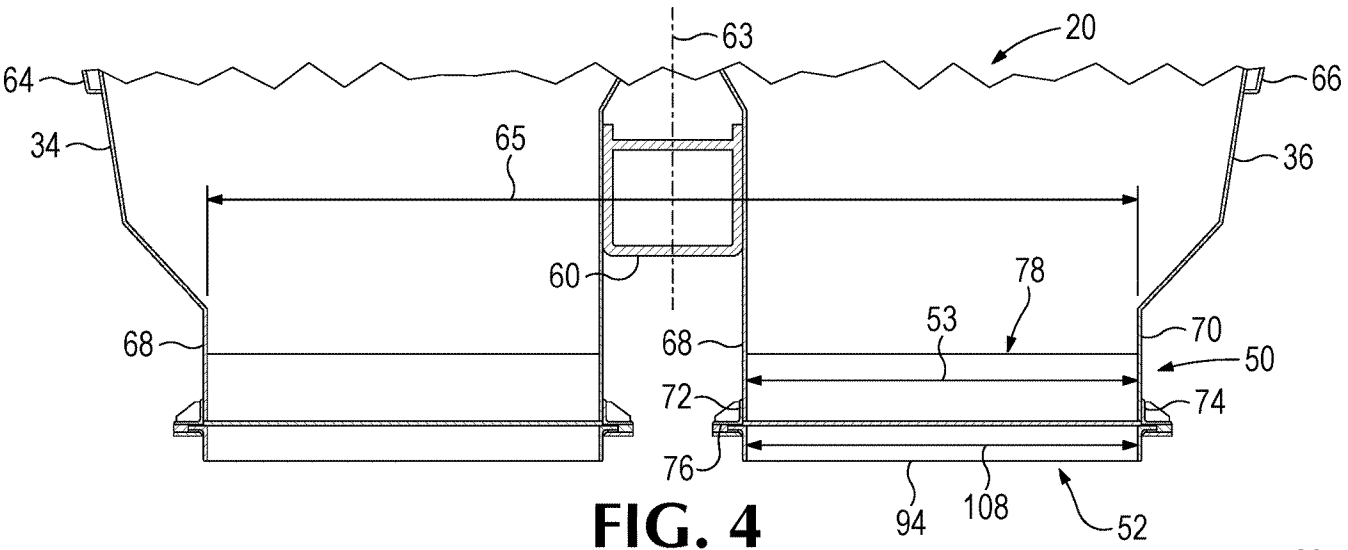
FIG. 4 is a sectional view taken on a transverse vertical plane along the line 4-4 in FIG. 1.
Figure 5:
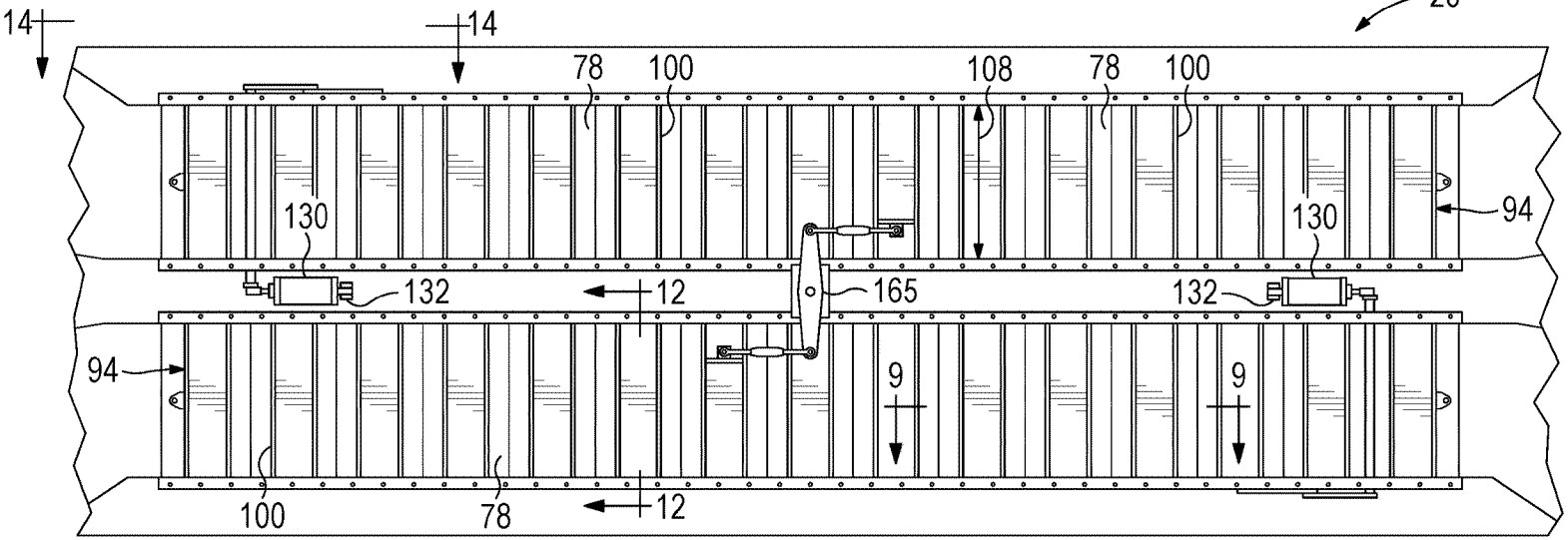
FIG. 5 is a bottom plan view of a portion of the hopper car shown in FIG. 1 showing the cargo discharge gate assembly in a closed condition.
Figure 6:
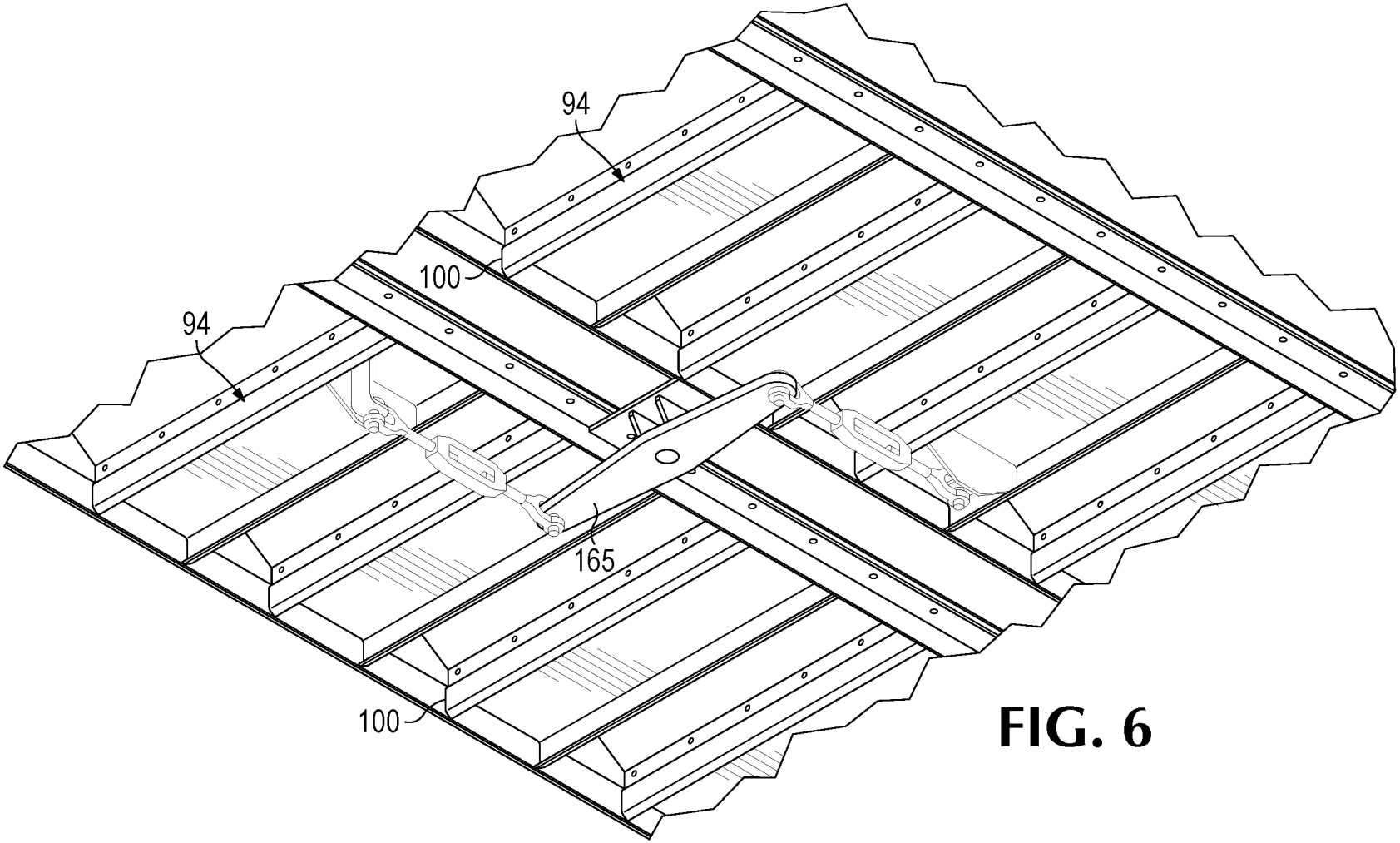
FIG. 6 is an isometric view taken from below and at one side of a portion of the cargo discharge gate assembly shown in FIG. 5.

As may be seen in FIGS. 1-3, at the first end 28 of the car body 22 there is a body bolster assembly 58 from which a center sill 60 extends to a similar body bolster 62 assembly at the opposite end 30 of the car body 22. The center sill 60 extends through the entire length 32 of the car body 22. The hopper car 20 may incorporate a pair of similar cargo discharge gate assemblies 52, as shown in FIGS. 2-4, with one of the pair of cargo discharge gate assemblies 52 located on each lateral side of a longitudinal center plane 63 of the car body 22. The hopper outlet portion of the hopper car body 22 thus has an overall width 65 comprising both of the cargo discharge gate assemblies 52 as may be seen in FIG. 4.

A pair of side sills 64 and 66 extend from the body bolster 58 to the body bolster 60 on respective sides of the car body 22. In a slightly different hopper car (not shown) there may be a stub center sill at each end of the car body 22, and instead of a center sill 60 extending through the entire length of the car body 22 the side sills 64 and 66 may be substantial enough to carry loads including bending forces and longitudinal train forces that might otherwise be carried by a center sill, as will be understood.

At the bottom of each of the hopper outlet portions 50 a longitudinally extending vertical side member 68 or 70 of the hopper outlet portion 50 extends from one end 54 to the other end 56 of the hopper outlet portion 50. The side members 68 and 70 may be steel plates of appropriate dimensions. The longitudinally extending hopper outlet portion vertical side members 68 and 70 extend along the bottom of each side wall of the car body and along an opposite side of the hopper outlet portion 50 nearer to the center sill 60. A cargo discharge gate longitudinal support member 72 or 74 extends along a bottom margin of each of the longitudinally extending vertical side members 68 and 70. The discharge gate assembly support members 72 and 74 may, for example be of angle iron or similar material welded to the longitudinal side members of the hopper outlet portion so as to have a downwardly-facing flat surface 76.

Each cargo discharge gate assembly 52 includes several transversely extending hopper bottom structures 78 which may have the form of cargo shed structures of similar size and shape. The hopper bottom cargo shed structures 78 extend between the vertical sides 68 and 70 of the hopper outlet portions 50, and may be welded to the vertical side members 68 and 70 to interconnect the opposite sides of the hopper outlet portion 50 with each other at regularly spaced intervals. The hopper bottom or cargo shed structures 78 thus may be integral structural members of the respective hopper outlet portion 50, and should therefore have sufficient strength to support the generally downward forces generated by grain or other bulk cargo carried in the hopper car 20. Each of the bulkheads 44 and 46 may extend upwardly from one of the cargo shed structures between cargo discharge gate openings.

The hopper bottom cargo shed structures 78 define and separate a plurality of similar cargo discharge openings 80, for example, at least 6 cargo discharge openings 80 that are aligned with each other and spaced apart from one another uniformly along the length of the hopper outlet portion 50. Each of the cargo discharge openings 80 may have a length 82, slightly less than a length 84 of each cargo shed structure. In a car body having a length 32 of 44 feet, for example, the length of the hopper discharge portion may be about 27 feet, and there may be, for example, 13 of the cargo shed structures 78 and 14 cargo discharge openings 80, including a cargo discharge opening 80 at each end 54 and 56 of the hopper outlet portion 50.

The hopper bottom cargo shed structures 78 may be of steel of other metal plate or sheet material and have the form of transversely-extending ridges whose opposite faces 86 and 88 are sloped to ensure that the intended type of bulk cargo slides downward along each cargo shed structure 78 toward an adjacent cargo discharge opening 80 as cargo is unloaded from the hopper car 20. Each of the cargo shed structures 78 may have a length 84 of, for example, about 11 inches, and each of the cargo discharge openings 80 may have a length 82 of about 10.5 inches. A vertical flange 90 or 92 may extend downward beneath each sloping face 86 and 88 of the cargo shed structure.

Figure 8:
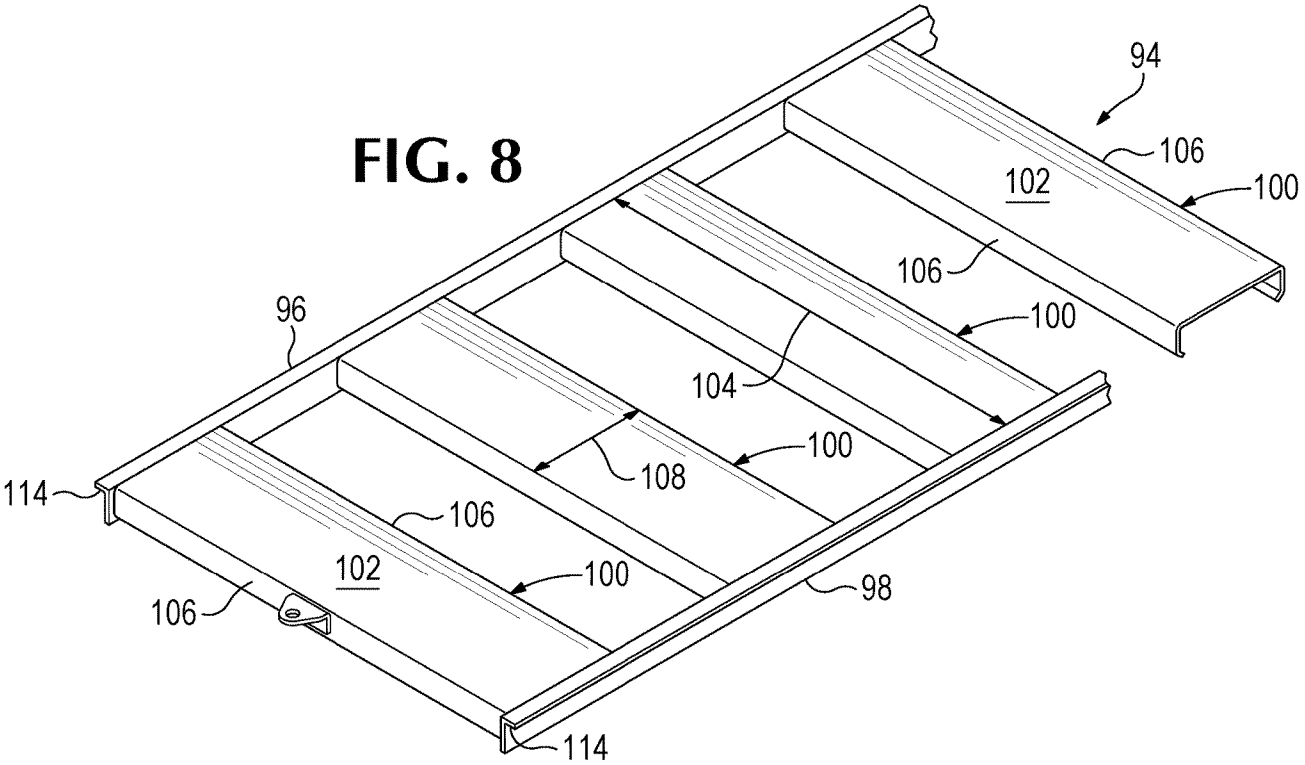
FIG. 8 is an isometric view of a unitary multi-gate closure assembly that is part of the cargo discharge gate assembly of the hopper car shown in FIG. 1.

A unitary multi-gate closure assembly 94, shown separately in FIG. 8, includes a pair of parallel, longitudinal, gate assembly side members 96 and 98, and a plurality of transversely extending gate closure members 100 whose opposite ends are welded to the side members. The side members 96 and 98 may be of angle stock, for example, as may be seen in FIGS. 12 and 13, and the gate closure members 100 may be formed of metal plate and have a shape shown best in FIGS. 9, 10, and 11. Each of the gate closure members 100 thus has a flat top portion 102 whose length 104 is about equal to the length 84 of each of the hopper bottom cargo shed structures 78, which are spaced apart from one another by a slightly smaller distance, defining the length 82 of the cargo discharge openings 80, for reasons that will be apparent presently. Integrally formed stiffener flange members 106 depend from the upper face of each gate closure member 100, stiffening the gate closure member 100 and giving each gate closure member 100 the general form of a downwardly-open channel or C-beam with of flanges that each present a generally vertical face.

Figure 10:
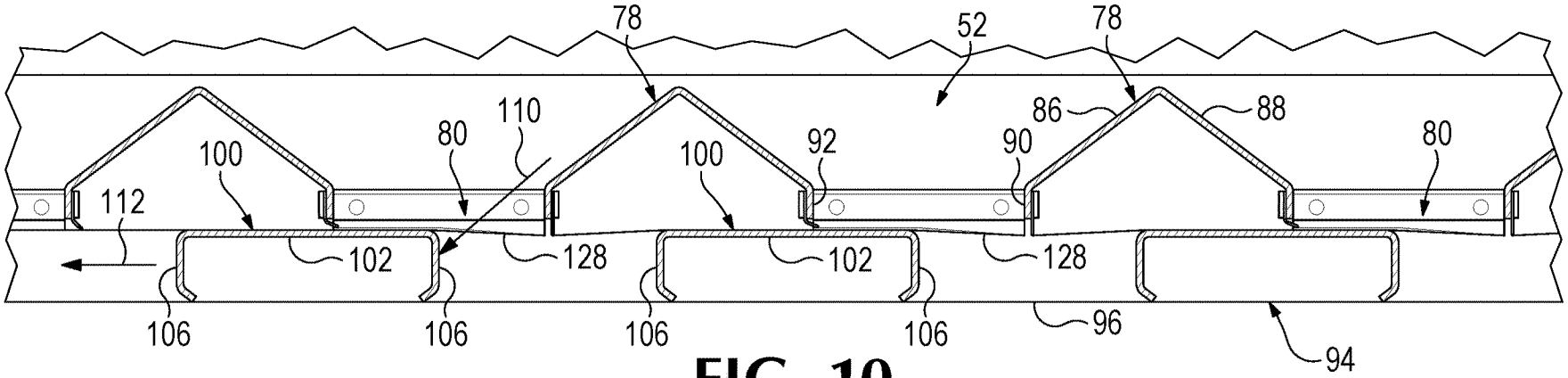
FIG. 10 is a view similar to FIG. 9, but showing the cargo discharge gate assembly in a halfway open condition.

Each gate closure member 100 has a width 108, extending transversely of the car body 22, about equal to the distance between the longitudinal side members 68 and 70 of the hopper outlet portion 50. When the cargo discharge gate assembly 52 is in a closed condition, the length 104 of each of the gate closure members 100 spans the length 82 of the respective cargo discharge opening 80 between consecutive ones of the hopper bottom cargo shed members 78, and each gate closure member 100 closes a respective cargo discharge opening 80. When the unitary multi-gate closure assembly 100 is in a partially open position, as shown in FIG. 10, grain or similar bulk cargo sliding down a sloping face 86 of an adjacent hopper bottom cargo shed structure 78 in the general direction indicated by the arrow 110 in FIG. 10 can impinge upon the vertical face of one of the flanges 106 of the gate closure member 100 as suggested by the arrow 110 and thus help to urge the unitary gate closure assembly 94 in the opening direction shown by the arrow 112.

Figure 12:
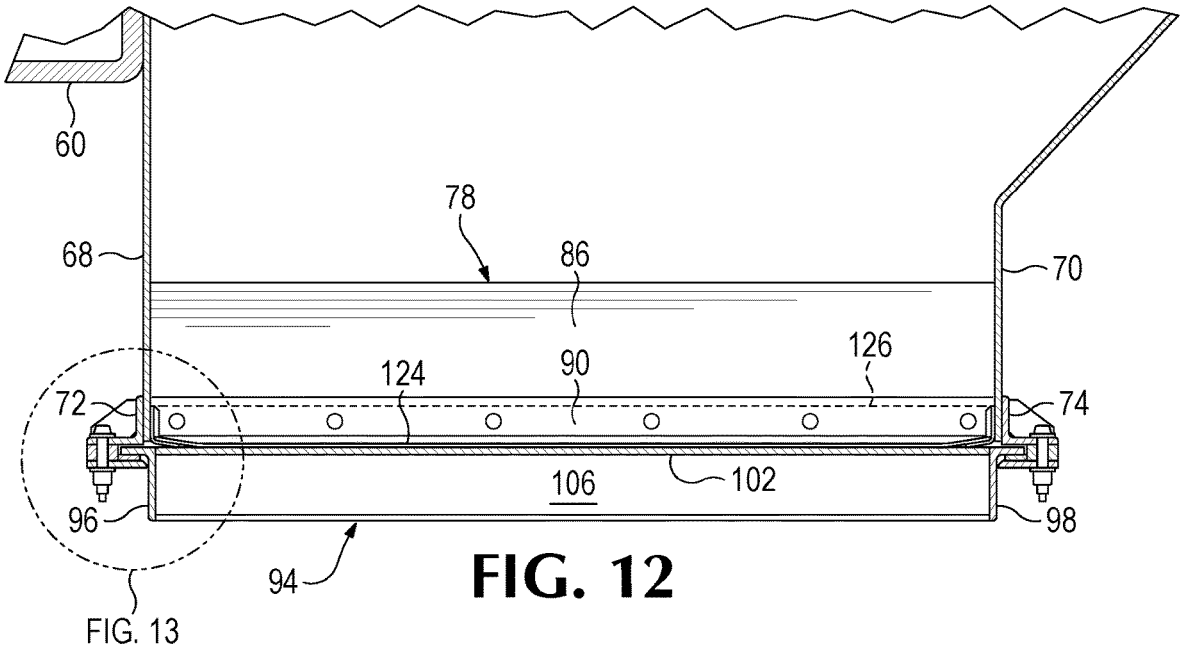
FIG. 12 is a sectional view, taken along line 4-4 in FIG. 1, at an enlarged scale, showing the manner in which a unitary multi-gate closure assembly is supported in a hopper discharge portion of the hopper car.
Figure 13:
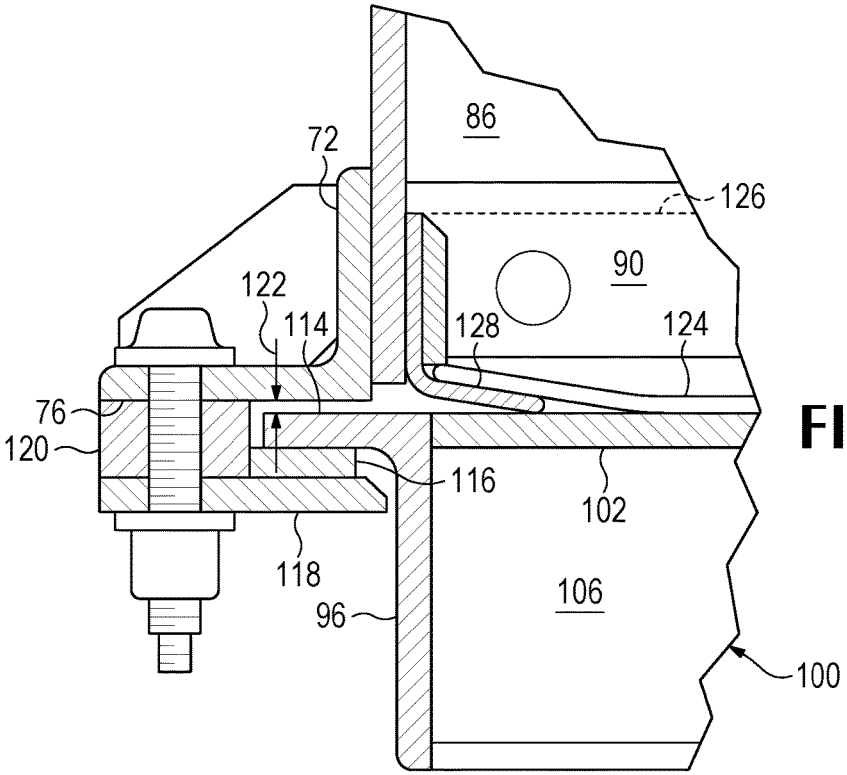
FIG. 13 is a detail view showing a portion of FIG. 12, at an enlarged scale.

As seen best in FIGS. 12 and 13, the unitary multi-gate closure assembly 94 is attached to the bottom of the hopper outlet portion 54 with laterally outwardly projecting flanges 114 of the angle stock of the unitary multi-gate closure assembly 94 side members 96 and 98 supported slidably on bearing blocks 116 of anti-friction material such as HDPE or the like, mounted on slide plates 118 fastened to the outwardly-extending flanges of the gate assembly longitudinal support member. Spacers 120 establish clearance 122 to permit the unitary multi-gate closure assembly 94 to slide easily despite inevitable downward deflection of the side members 68 and 70 of the hopper outlet portion 50 of the car body and the gate assembly longitudinal support members 72 and 74 when the hopper 42 is loaded with cargo.

The unitary multi-gate closure assembly 94 is preferably more flexible than the car body 22 in response to the weight of cargo in the hopper 42, as might be seen in a vertical, longitudinal, plane. Thus, should the bending forces on the car body 22 resulting from the weight of cargo result in some downward deflection of the slide plates 118 in the mid-length part of the car body 22, the unitary multi-gate closure assembly 94 will be able to accommodate such changes in the path along which the multi-gate closure assembly must slide between a closed condition and an open condition.

The slide plates 118 and spacers 120 may be attached to the outwardly extending flanges of the discharge gate assembly longitudinal support members 72 and 74 by fasteners 122 such as husk bolts or rivets, so that by removing the fasteners 122 the slide plate 118 can be removed along either or both sides of the hopper outlet portion 50, allowing the unitary multi-gate closure assembly 94 to be lowered and removed laterally from its normal position closely beneath the transverse hopper bottom cargo shed structures 78 in the event that repair is needed. This simplifies repair of the cargo discharge gate assembly, since the unitary multi-gate closure assembly 94 does not need to be withdrawn from an end of the hopper outlet portion, which would require the car body 22 to be raised clear of one of the wheeled trucks 24, 26.

Figure 9:
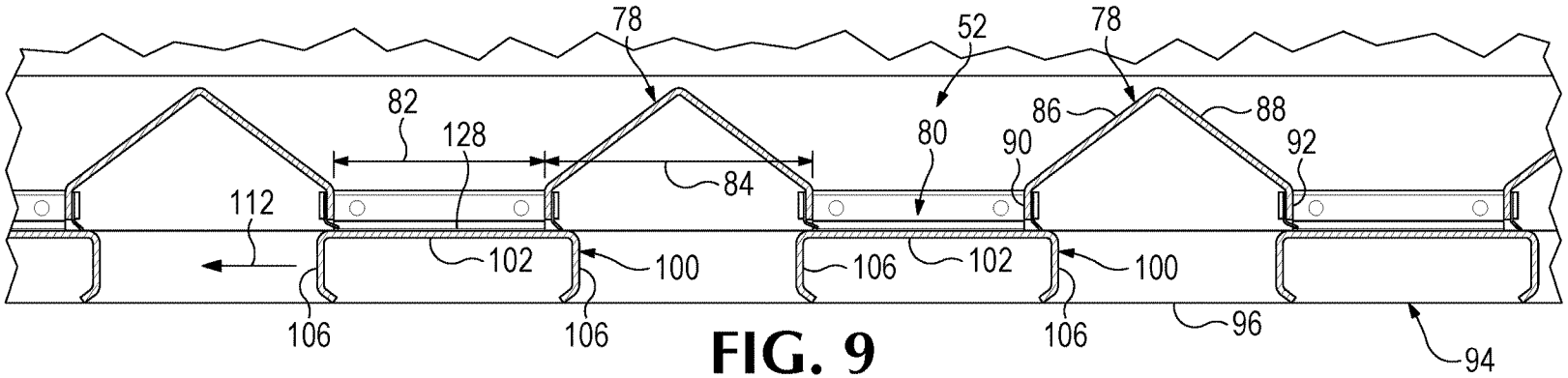
FIG. 9 is a sectional view taken along line 9-9 of FIG. 5, showing a portion of the hopper car shown in FIGS. 1, 2 and 3, at an enlarged scale, showing the gravity outlet cargo discharge gate assembly in a closed condition.

Transverse flexible seals 124 that press upon the top 102 of each gate closure member 100 of the unitary multi-gate closure assembly 94 are mounted on and extend along the vertical flange portions 90 and 92 of each of the transverse bottom cargo shed structures 78. The seals 124 may be strips of fabric-reinforced elastomeric material, such as or similar to flat drive belting material. An upper portion of each seal 124 may be fastened to the respective vertical flange 90 or 92 of a transverse hopper bottom cargo shed structure 78 by a seal mounting bar 126 of suitable metal, bolted or riveted to the vertical flange portion 90 or 92 of the hopper bottom cargo shed structure. A lower margin portion of each seal 124 depends and presses on the top 102 of the adjacent gate closure member 100, as may be seen best in FIGS. 9, 10, and 11. As a result of the length 104 of the gate closure member 100 being greater than the length 82 of the cargo discharge openings distance between cargo shed structures 78, a seal 124 on each of the cargo shed structures 78 between which a gate closure member 100 is located remains firmly in sealing contact with the top 102 of the gate closure member 100 when the cargo discharge gate assembly 52 is closed, as shown in FIG. 9. Similar seal members 128 are mounted on and extend along the sides of the hopper outlet portion between the hopper bottom cargo shed structures 78 and press downward on the top 102 of each unitary multi-gate closure member 100 adjacent to the side member 68 or 70 when the cargo discharge assembly 52 is closed.

Figure 7:
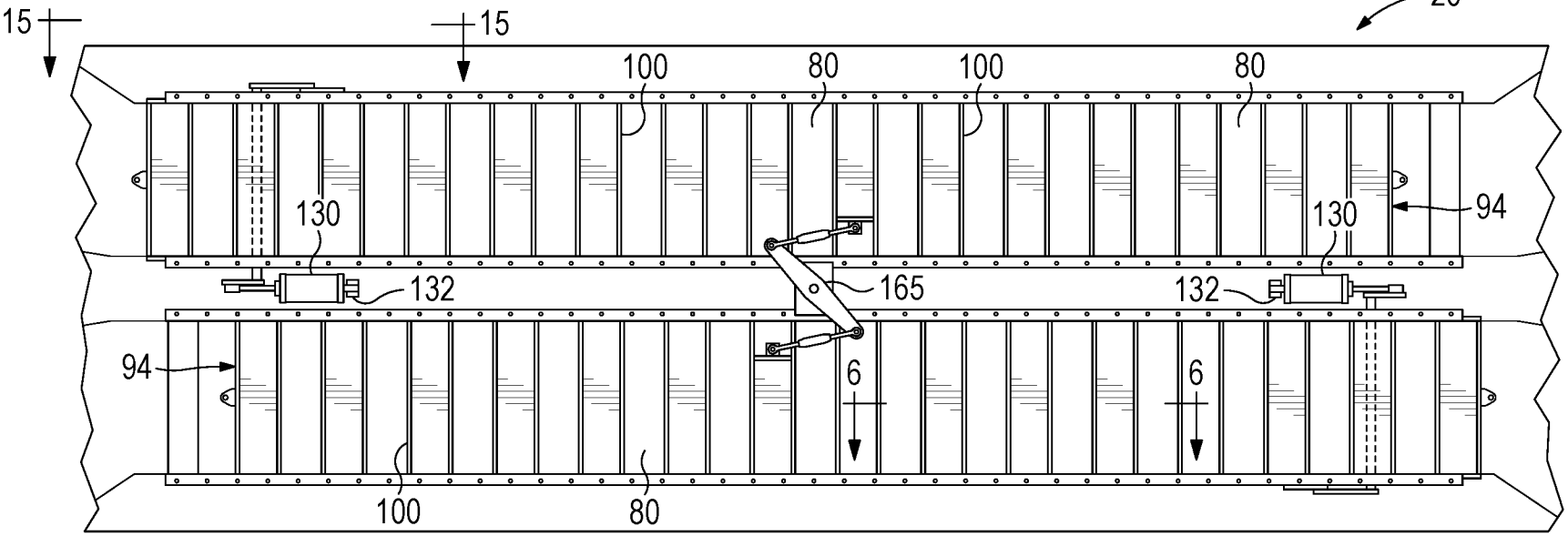
FIG. 7 is a bottom plan view similar to FIG. 5, but showing the cargo discharge gate assembly in an open condition.
Figure 11:
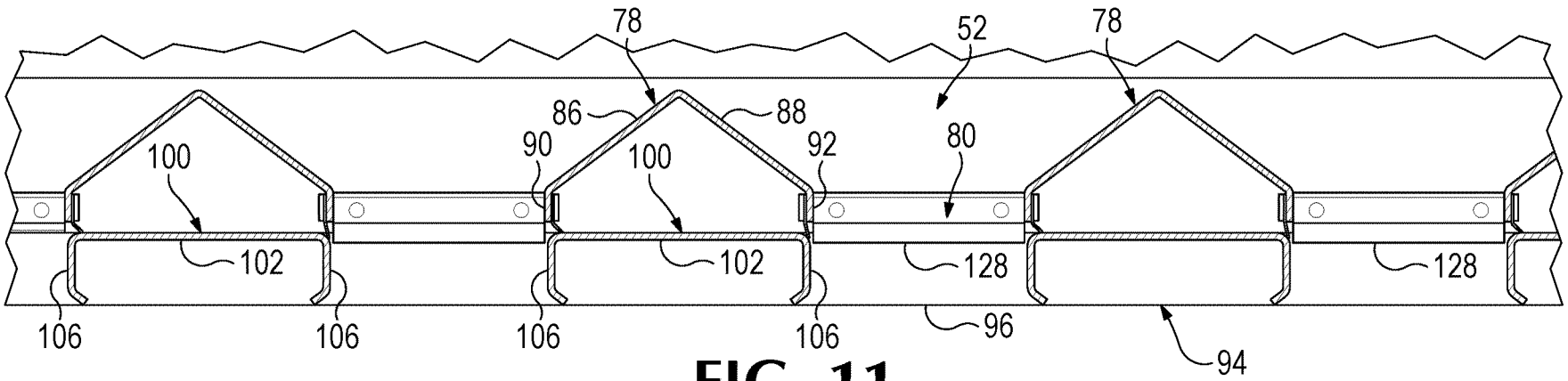
FIG. 11 is a view similar to FIGS. 9 and 10, but showing the cargo discharge gate assembly in a fully open condition.
Figure 14:
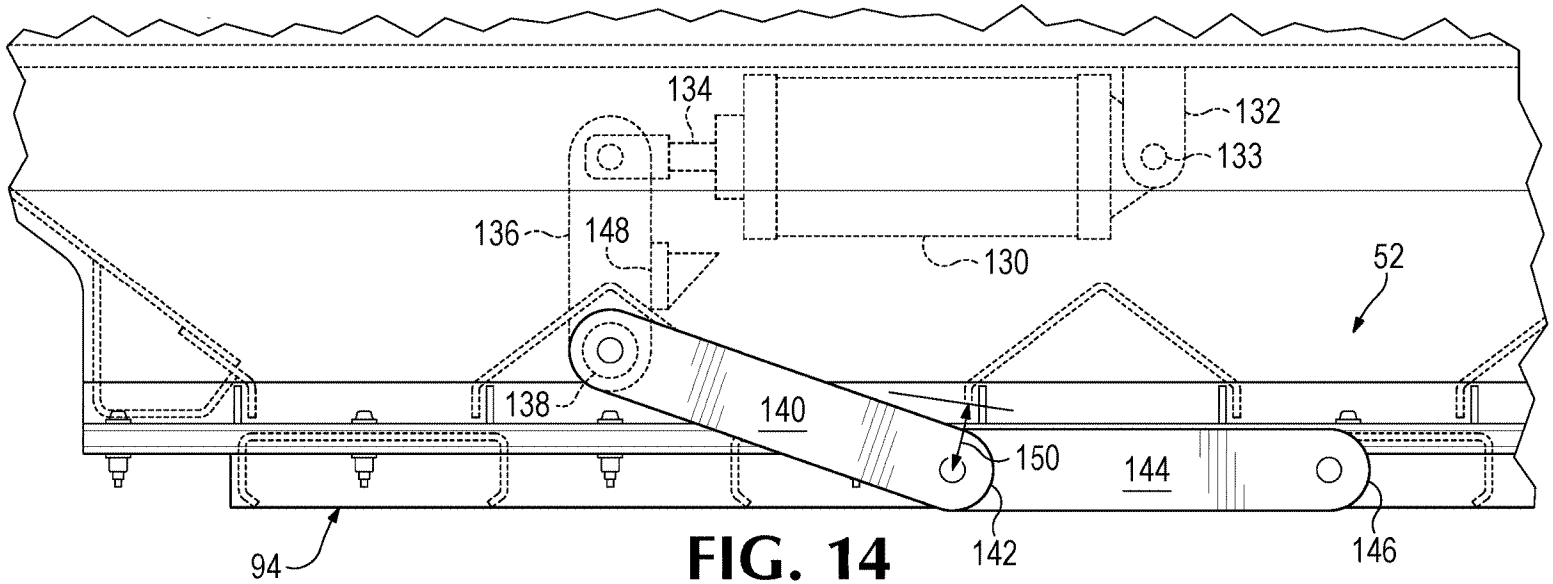
FIG. 14 is a side elevational view taken along line 1444 in FIG. 5, showing a mechanism for opening and closing the cargo discharge gate assembly, with the cargo discharge gate assembly in a closed condition.
Figure 15:
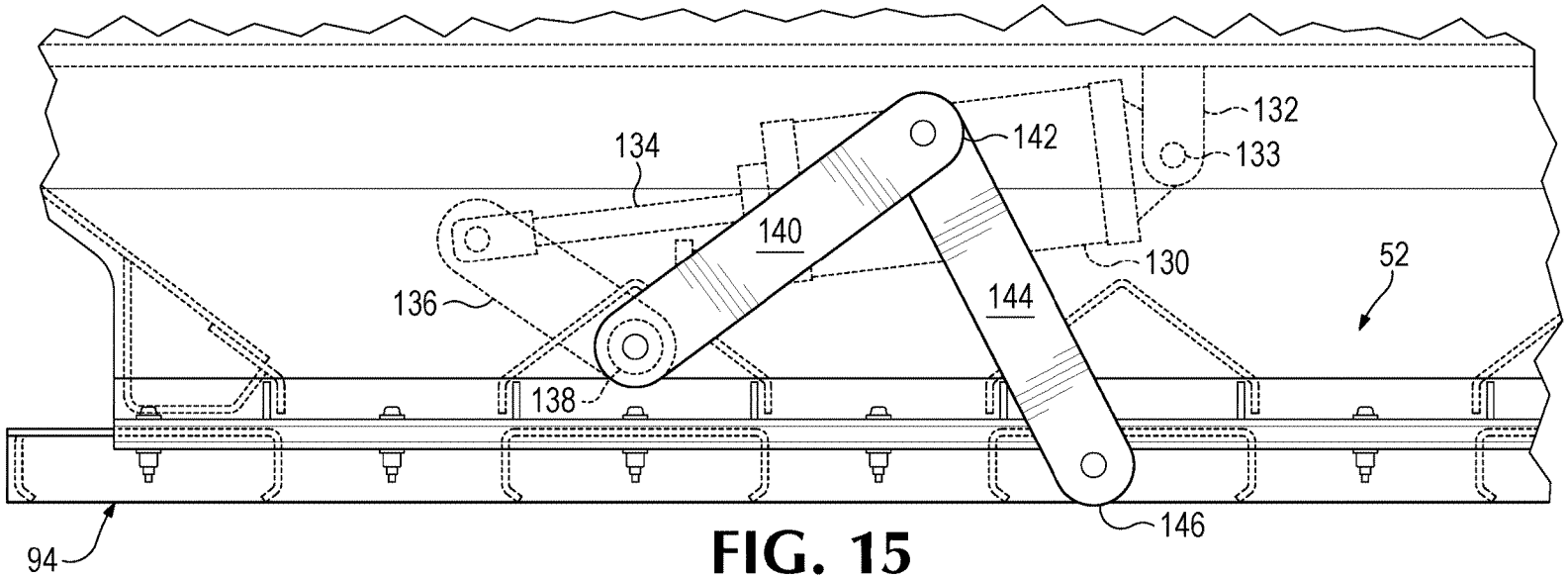
FIG. 15 is a view of the same portion of the car body as shown in FIG. 14, but showing the mechanism for opening and closing the cargo discharge gates with the cargo discharge gates in an open condition.
Figure 16:
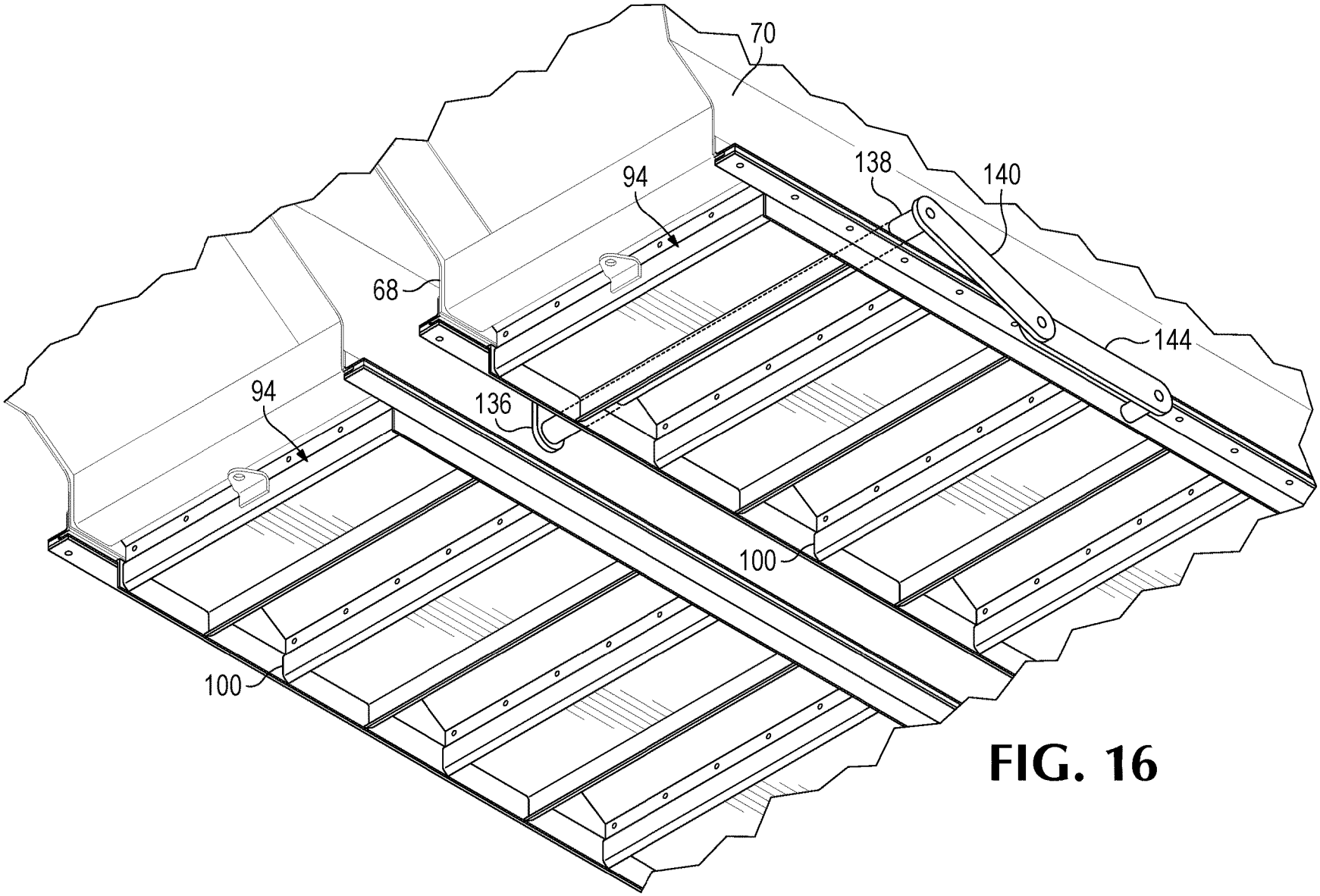
FIG. 16 is an isometric view taken from below and at one side of the portion of the car body shown in FIG. 14, at an enlarged scale.

The unitary multi-gate closure assembly 94 is supported as explained above in a manner that permits it to slide with respect to the sides 68 and 70 of the hopper outlet portion 50 between its position in the closed condition of the cargo discharge gate assembly 52, shown in FIGS. 2, 3, 5, 6, 9, 14, and 16, and the open condition shown in FIGS. 7, 11, and 15. As shown in FIGS. 14-16, a gate actuator mechanism includes a gate opening motor, such as a fluid-driven cylinder and piston assembly 130, that may be located at either end of the car body 22, beneath the center sill 60 or at an end of the center sill.

A suitable supply of fluid under pressure, such as compressed air, is made available to the cylinder-and-piston assembly 130 and the necessary conduits and valves (not shown) are provided to control operation. While an externally available supply of fluid such as compressed air may be connected to an individual hopper car 20 and used to operate the cargo discharge gate assembly 52, an auxiliary train line may preferably to provide a supply of compressed air from the locomotive of a unit train several similar hopper cars 20.

As shown in FIGS. 7, 14, 15, and 16, the cylinder and piston assembly 130 may be attached conveniently to a mounting 132 at the bottom of the center sill 60 near an end of the hopper outlet portion 50 of the car body 22, with an end of the cylinder mounted so that it can pivot with respect to the mounting 132 about a horizontal axis 133. The outer end of a piston rod 134 is connected to a gate drive crank arm 136 which is attached drivingly to a horizontal gate-opening shaft 138. The shaft 138 extends transversely beneath one of the cargo shed structures 78 toward the laterally outer side of the hopper outlet portion 50 of the car body 22. To move the unitary multi-gate assembly 94 longitudinally of the car body 22, a lever arm 140 is attached to and driven by the outboard end of the shaft 138, and an outer end 142 of the lever arm 140 is attached through a pivot joint to a connecting link 144 whose opposite end 146 is connected with an outer side rail member 98 of the unitary multi-gate closure assembly 94.

With the piston retracted into the cylinder 130 as shown in FIG. 14 the gate closure members 100 of the unitary multi-gate closure assembly 90 span the cargo discharge openings 80 between the hopper bottom cargo shed structures 78, and the cargo discharge gate assembly 52 is in a closed condition. When the cargo discharge gate assembly 52 is in its closed condition the gate drive crank arm 136 rests against a positive stop 148 as shown in FIG. 14. Movement of the piston to extend the piston rod 134 to the position shown in FIG. 15 moves the gate drive crank arm 136 counterclockwise and down as seen in FIG. 14, rotating the transverse shaft 138 and the lever arm 140 at the outboard end of the shaft 138. This pulls the connecting link 144, moving the unitary multi-gate closure assembly 94 along the slide plates 118 to the position shown in FIG. 15, where the cargo discharge openings 80 are fully open to allow cargo to flow out of the cargo hopper 42. The gate actuating mechanism thus pulls the unitary multi-gate closure assembly in an opening direction, rather than pushing it.

The arrangement of the cylinder and piston assembly 130 shown in FIGS. 14 and 15 results in the piston rod 134 being extended from the cylinder and exposed to airborne dust and dirt only when the cargo discharge gate assembly 52 is in the open condition shown in FIG. 15. When the cargo discharge gate assembly 52 is closed, as shown in FIG. 14, the piston rod 134 is housed within the cylinder and protected from the weather and air-borne materials that might abrade or corrode the piston rod 134.

The gate drive crank arm 136 may be located and oriented as shown in FIG. 14 so that an impact resulting in inertia trying to move the unitary multi-gate closure assembly 94 in a gate-opening direction with respect to the car body 22 will result in the gate drive crank arm 136 encountering the positive stop 148 or the piston being bottomed out in the cylinder, as the outer end 142 of the lever arm 140 is in an over-center condition as indicated by the arrow 150. The unitary multi-gate closure assembly 94 has no room to move beyond the fully closed position shown in FIG. 14 in response to an opposite impact.

Figure 17:
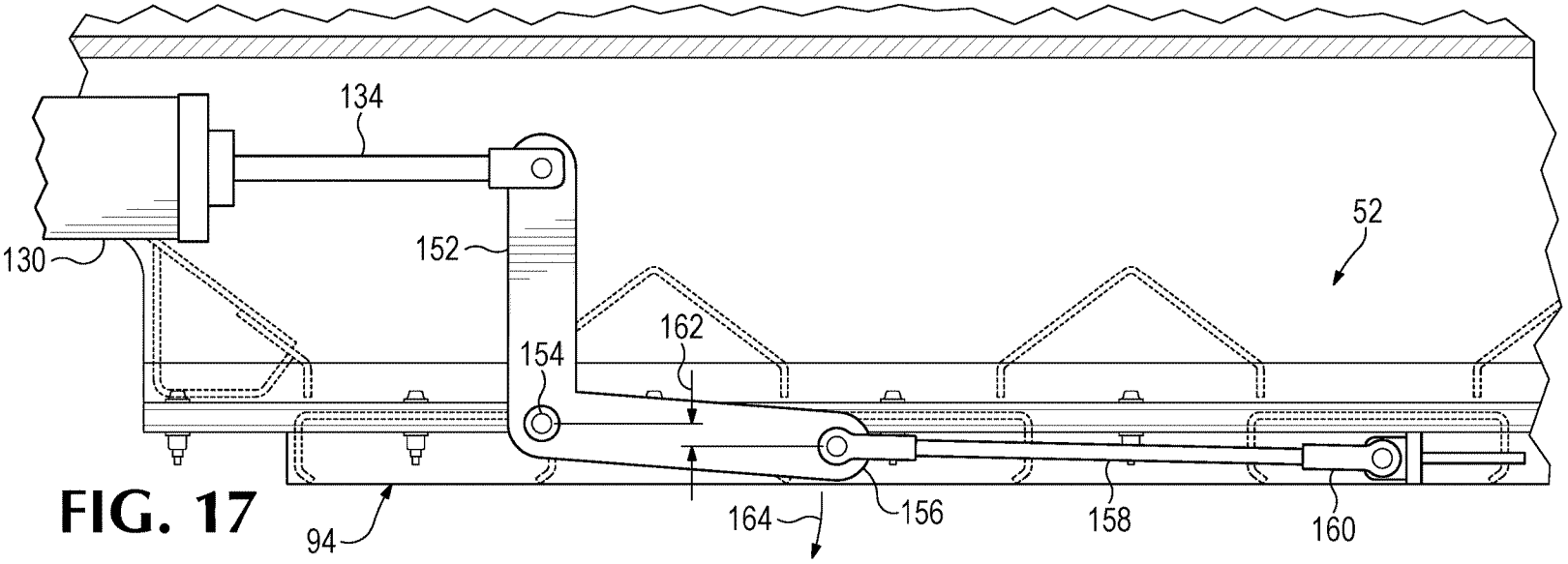
FIG. 17 is a side elevational view similar to FIG. 14 but showing a variation of the mechanism for opening and closing the cargo discharge gate assemblies.
Figure 18:
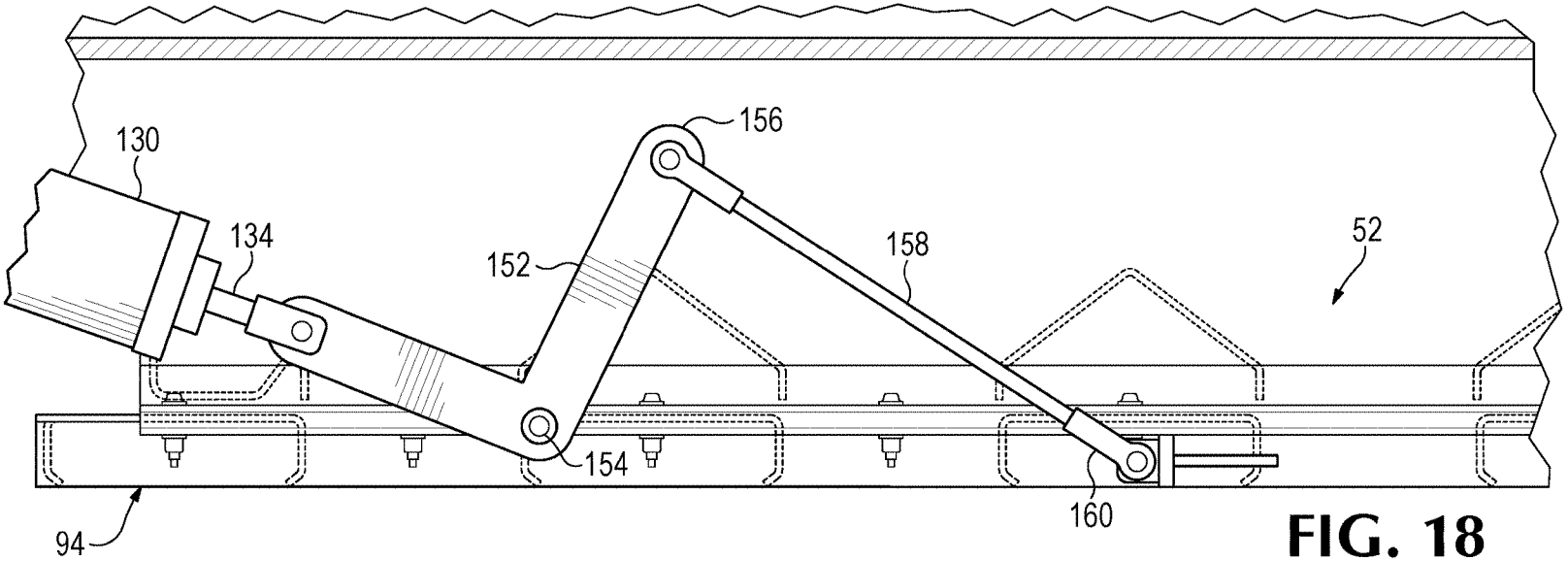
FIG. 18 is a side elevational view of the same portion of the car body as shown in FIG. 17, but showing the mechanism for opening and closing the cargo discharge gate assemblies with the cargo discharge gates in an open condition.

In an alternative arrangement, shown in FIGS. 17 and 18, the cylinder and piston assembly is mounted in an opposite position with respect to the gate drive bell crank 152, and the piston rod is extended when the cargo discharge gate assembly is in the closed condition. The bell crank 152 is mounted on a pivot 154 and is driven by the piston rod 134. An outer end 156 of the bell crank 152 is attached to an inner end of a connecting rod 158 having an opposite end 160 attached to the unitary multi-gate closure assembly, 94. The outer end 156 of the bell crank 162 goes through an over-center movement as indicated by the arrow 162 in FIG. 17 to move the unitary multi-gate closure assembly 94 to a fully closed position. An impact tending to open the cargo discharge gate assembly 152 shown in FIGS. 17 and 18 would be ineffective, as it would tend to drive the bell crank 152 in the direction indicated by the arrow 164, and the piston rod 134 would prevent movement.

As shown in FIGS. 2-7, in a hopper car 20 including a full-length center sill 60 there may be a pair of cargo discharge gate assemblies 52, one on each lateral side of the center sill 60 and thus on opposite lateral sides of a longitudinal centerline plane of the car body 22. A separate gate actuating mechanism may be provided at each end of the car body 22 for a respective one of the cargo discharge gate assemblies 52. To counter the possibility of the cargo discharge gate assemblies 52 being opened by inertia when the hopper car 20 is humped and bumps into another car, the unitary multi-gate closure assemblies 94 on opposite sides of the center sill 60 are arranged to move in opposite directions with respect to the car body 22 when being opened. For that reason they are interconnected by a pivoted reversing yoke 165 so that movement of one of the multi-gate closure assemblies requires the other one also to move in the opposite direction with respect to the car body 22. As a result, longitudinal effects of inertia on the cargo discharge gate assemblies when the car is subjected to a longitudinal impact may tend to move one unitary multi-gate closure assembly in a gate-opening direction, but the reversing yoke 165 tends to transfer that inertia to the other multi-gate assembly to urge it to move in an opposite direction against the effect of inertia. The reversing yoke 165 thus acts as a lock opposing any effects of longitudinal train inertia on the cargo discharge gate assemblies, and neither cargo discharge gate assembly will be opened inadvertently as a result of lengthwise impact.

In such a hopper car 20 in which the total width of the hopper outlet portion 50 of the car is greater than the distance between the rails on which the wheeled trucks of the car are situated, discharge of cargo from the car requires that there be a cargo-receiving bin having a width approaching the overall width 37 of the car body itself. While such a car would be able to discharge its cargo quickly, there are still many rail terminals where such a cargo-receiving bin is not available, and cargo must be discharged into a cargo-receiving bin through an opening between the rails on which the car is located.

Figure 19:
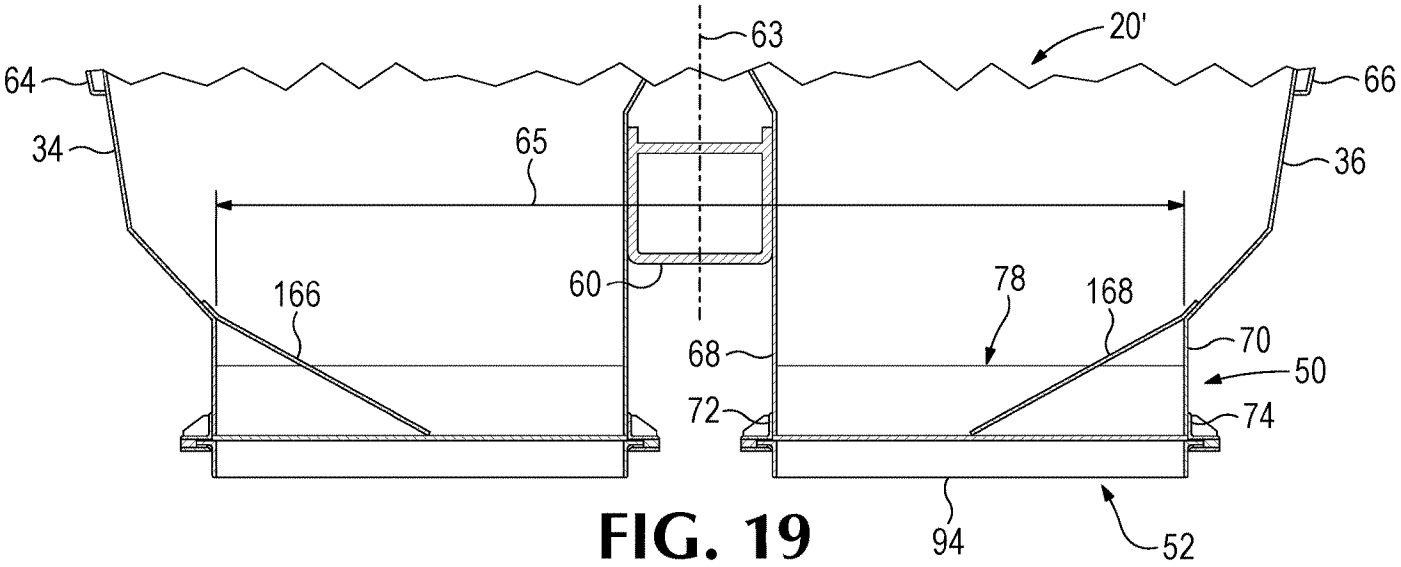
FIG. 19 is a section view taken in the same direction as FIG. 4, but showing the hopper car body with a cargo discharge portion which is a variation from the configuration of the car shown in FIGS. 1-16.
Figure 20:
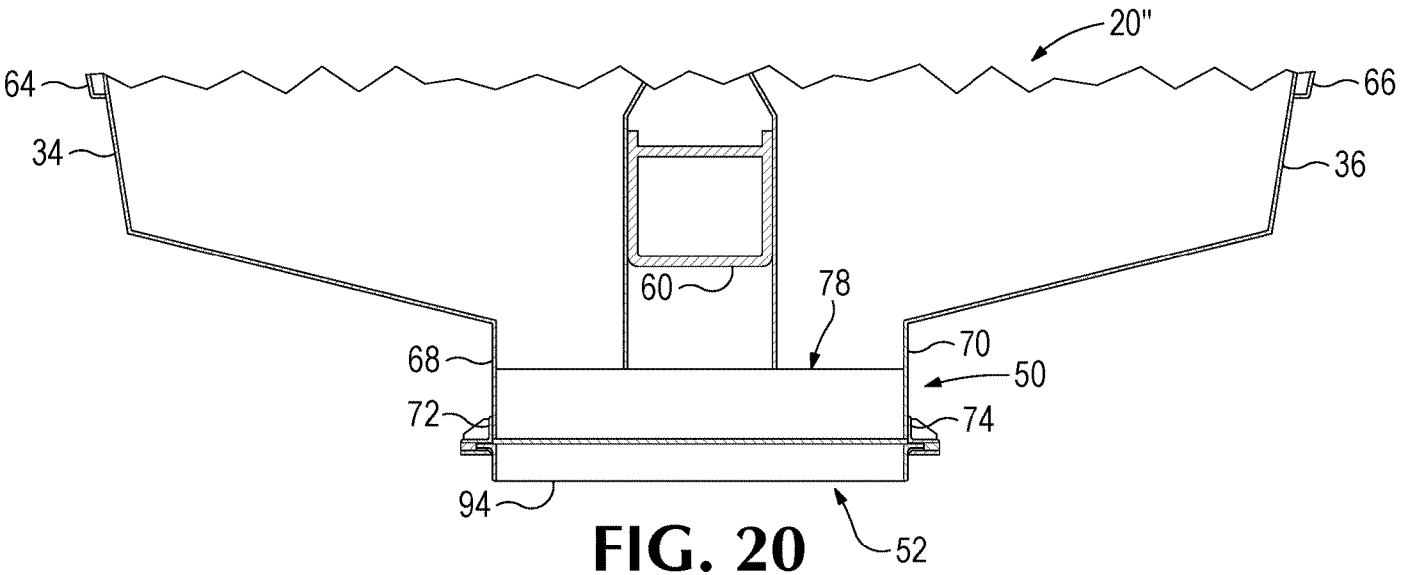
FIG. 20 is a sectional view taken in the same direction as FIG. 4, but showing the hopper car body with a cargo discharge portion which is yet another variation from the configuration of the car shown in FIGS. 1-16.

For a hopper car 20' that is intended for use in service where such a limited cargo-receiving width may be all that is currently available, the car body 22 may be equipped, as shown in FIG. 19, with laterally inwardly sloping auxiliary cargo shed plates 166, 168 mounted in the bottom of the cargo hopper 42 on each lateral side of the hopper outlet portion 50 to direct the cargo inward toward the longitudinal center plane 63 of the car 20 for discharge into a receiving bin located between the rails. The auxiliary cargo shed plates 166, 168 can be removed at a later time during the life of the car to enable the full width of the cargo discharge gate assemblies 52 of the car 20' to be utilized.

Where it is anticipated that a hopper car 20" will be required to discharge cargo into a cargo-receiving bin of limited width throughout the entire service life of the car 20", a single cargo discharge gate assembly 52 may be located centrally with respect to the width 37 of the hopper car, as shown in FIG. 20.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A railroad hopper car, comprising:

(a) a car body having a pair of opposite ends and a length and defining a hopper;

(b) a pair of wheeled trucks supporting the car body, each of the trucks being located at a respective one of the opposite ends of the car body;

(c) a hopper outlet portion included at a bottom of the hopper, the hopper outlet portion having a width and having a hopper outlet length extending longitudinally with respect to the car body between the wheeled trucks;

(d) a cargo discharge gate assembly in the hopper outlet portion;

(e) a plurality of transversely-extending hopper bottom members spaced apart from one another along the hopper outlet length and defining a plurality of hopper outlet openings spaced apart from one another along the length of the hopper outlet portion;

(f) a unitary multi-gate closure assembly including a pair of longitudinally extending side rail members and a plurality of transversely-extending gate closure members spaced apart from one another longitudinally with respect to the hopper outlet portion and extending transversely with respect to the hopper outlet portion, the gate closure members being mounted on the side rail members and being located along the side rail members in respective locations corresponding to respective locations of the hopper outlet openings;

(g) a gate support structure including a pair of longitudinal supports along respective opposite lateral sides of the hopper outlet portion, each of the longitudinal supports engaging a respective one of the side rail members of the unitary multi-gate closure assembly; and (h) a gate actuator mechanism adapted to slide the unitary multi-gate closure assembly longitudinally with respect to the car body between a closed position and an open position of the cargo discharge gate assembly.

2. The railroad hopper car of claim 1 wherein the cargo discharge gate assembly extends through substantially the entire length of the hopper outlet portion.

3. The railroad hopper car of claim 1 wherein the hopper outlet portion has a hopper outlet portion length that is greater than half the length of the car body.

4. The railroad hopper car of claim 1 including at least 6 hopper outlet openings spaced apart from one another along a length of the hopper outlet portion.

5. The railroad hopper car of claim 1 wherein the gate actuator mechanism includes an over-center locking feature arranged to prevent the unitary multi-gate closure assembly from moving without actuation of the gate-opening mechanism.

6. The railroad hopper car of claim 1 wherein the gate actuator mechanism is connected with the gate assembly at an end of the car and wherein the gate actuator mechanism is arranged to pull the unitary multi-gate assembly toward the end of the car at which the gate actuator mechanism is located when moving the gate assembly from a closed position to an open position.

7. The railroad hopper car of claim 1 wherein one of the gate closure members includes a generally downwardly extending flange having a vertical face located so as to be impinged on and pressed in a gate-opening direction by a flow of cargo being discharged from the hopper.

8. The railroad hopper car of claim 1 wherein the car body includes a stub center sill at each end thereof and is free from a center sill extending through the cargo hopper, and wherein the cargo discharge gate assembly is centrally located with respect to the width of the car body.

9. The railroad hopper car of claim 1 wherein the car body includes a pair of cargo discharge gate assemblies, each extending longitudinally of the car body on a respective lateral side of a longitudinal central plane of the car body and wherein each of the cargo discharge gate assemblies of the pair includes a respective gate actuator mechanism, the gate actuator mechanisms being located respectively at opposite ends of the car body, and each of the unitary multi-gate closure assemblies being interconnected with the other through a reversing yoke, so that movement of either of the unitary multi-gate closure assemblies longitudinally with respect to the car body causes opposite movement of the other of the gate assemblies longitudinally with respect to the car body.

10. The railroad hopper car of claim 9 wherein the unitary gate closure assemblies of the cargo discharge gate assemblies move in opposite longitudinal directions in opening, and wherein inertia tending to open one of the cargo discharge gate assemblies is countered by the inertia of the other cargo discharge gate assembly acting through the reversing yoke.

11. The railroad hopper car of claim 1 wherein the gate actuator mechanism includes a cylinder-and-piston assembly interconnected with the unitary multi-gate closure assembly through a lever arranged to move through an over-center path in moving the unitary multi-gate assembly between the closed position and the open position with respect to the cargo discharge openings.

12. The railroad hopper car of claim 1 wherein each gate closure body has an inverted channel form including transverse stiffener flange portions extending downward.

13. The railroad hopper car of claim 1 including a flexible seal strip extending longitudinally along the gate support structure between consecutive ones of the transversely extending hopper bottom members separating consecutive ones of the discharge openings, the seal strip pressing upon a respective gate closure member when the cargo discharge gate assembly is in its closed condition.

14. The railroad hopper car of claim 1 including a flexible seal strip extending longitudinally along a flange of one of the transversely extending hopper bottom members separating consecutive ones of the discharge openings, the seal strip pressing upon a respective gate closure member when the cargo discharge gate assembly is in its closed condition.

15. The railroad hopper car of claim 1 wherein each of the transversely-extending hopper bottom members includes a respective cargo discharge-guiding surface sloping toward a respective one of the cargo discharge openings.

16. A railroad hopper car, comprising:

(a) a car body having a pair of opposite ends and a length and defining a hopper;

(b) a pair of wheeled trucks supporting the car body, each of the trucks being located at a respective one of the opposite ends of the car body;

(c) a hopper outlet portion included at a bottom of the hopper, the hopper outlet portion having a width and having a hopper outlet length extending longitudinally with respect to the car body between the wheeled trucks;

(d) a cargo discharge gate assembly in the hopper outlet portion;

(e) a plurality of transversely-extending hopper bottom members spaced apart from one another along the hopper outlet length and defining a plurality of hopper outlet openings spaced apart from one another along the length of the hopper outlet portion;

(f) a unitary multi-gate closure assembly including a pair of longitudinally extending side rail members and a plurality of transversely-extending gate closure members spaced apart from one another longitudinally with respect to the hopper outlet portion and extending transversely with respect to the hopper outlet portion, the gate closure members being mounted on the side rail members and being located along the side rail members in respective locations corresponding to respective locations of the hopper outlet openings;

(g) a gate support structure including a pair of longitudinal supports along respective opposite lateral sides of the hopper outlet portion, each of the longitudinal supports engaging a respective one of the side rail members of the unitary multi-gate closure assembly; and (h) a gate actuator mechanism adapted to move the unitary multi-gate closure assembly between a closed position and an open position of the cargo discharge gate assembly, wherein the gate support structure includes a separate longitudinal slide support member that is removable, and wherein removal of the slide support member permits the multi-gate closure assembly to be withdrawn in a lateral direction and removed from engagement with the gate support structure of the hopper outlet portion of the car.

17. A railroad hopper car, comprising:

(a) a car body having a pair of opposite ends and a length and defining a hopper;

(b) a pair of wheeled trucks supporting the car body, each of the trucks being located at a respective one of the opposite ends of the car body;

(c) a hopper outlet portion included at a bottom of the hopper, the hopper outlet portion having a width and having a hopper outlet length extending longitudinally with respect to the car body between the wheeled trucks;

(d) a cargo discharge gate assembly in the hopper outlet portion;

(e) a plurality of transversely-extending hopper bottom members spaced apart from one another along the hopper outlet length and defining a plurality of hopper outlet openings spaced apart from one another along the length of the hopper outlet portion;

(f) a unitary multi-gate closure assembly including a pair of longitudinally extending side rail members and a plurality of transversely-extending gate closure members spaced apart from one another longitudinally with respect to the hopper outlet portion and extending transversely with respect to the hopper outlet portion, the gate closure members being mounted on the side rail members and being located along the side rail members in respective locations corresponding to respective locations of the hopper outlet openings;

(g) a gate support structure including a pair of longitudinal supports along respective opposite lateral sides of the hopper outlet portion, each of the longitudinal supports engaging a respective one of the side rail members of the unitary multi-gate closure assembly; and (h) a gate actuator mechanism adapted to move the unitary multi-gate closure assembly between a closed position and an open position of the cargo discharge gate assembly, wherein each of the longitudinal side rail members of the unitary multi-gate closure assembly extends along a respective lateral side of the unitary multi-gate closure assembly and interconnects all of the gate closure members of the gate assembly with each other.

18. A railroad hopper car, comprising:

(a) a car body having a pair of opposite ends and a length and defining a hopper;

(b) a pair of wheeled trucks supporting the car body, each of the trucks being located at a respective one of the opposite ends of the car body;

(c) a hopper outlet portion included at a bottom of the hopper, the hopper outlet portion having a width and having a hopper outlet length extending longitudinally with respect to the car body between the wheeled trucks;

(d) a cargo discharge gate assembly in the hopper outlet portion;

(e) a plurality of transversely-extending hopper bottom members spaced apart from one another along the hopper outlet length and defining a plurality of hopper outlet openings spaced apart from one another along the length of the hopper outlet portion;

(f) a unitary multi-gate closure assembly including a pair of longitudinally extending side rail members and a plurality of transversely-extending gate closure members spaced apart from one another longitudinally with respect to the hopper outlet portion and extending transversely with respect to the hopper outlet portion, the gate closure members being mounted on the side rail members and being located along the side rail members in respective locations corresponding to respective locations of the hopper outlet openings;

(g) a gate support structure including a pair of longitudinal supports along respective opposite lateral sides of the hopper outlet portion, each of the longitudinal supports engaging a respective one of the side rail members of the unitary multi-gate closure assembly; and (h) a gate actuator mechanism adapted to move the unitary multi-gate closure assembly between a closed position and an open position of the cargo discharge gate assembly, wherein the hopper outlet portion has a width greater than a separation distance between rails upon which the wheeled trucks of the hopper car are designed to be carried, and wherein there are a pair of sloping auxiliary cargo shed plates, each extending from a respective side member of the hopper discharge portion downward and laterally inward and producing an effective lateral width of the cargo discharge gates no greater than the separation distance between the rails.

* * * * *